United States Patent [19]

Charlton

[11] 4,215,859

[45] Aug. 5, 1980

[54] CUE BRIDGE

[76] Inventor: Steven D. Charlton, 3511 Highway "D", West Bend, Wis. 53095

[21] Appl. No.: 923,158

[22] Filed: Jul. 10, 1978

[51] Int. Cl.[2] ..... A63D 15/10

[52] U.S. Cl. ..... 273/23; 273/68

[58] Field of Search ..... 273/23, 24, 14

[56] References Cited

U.S. PATENT DOCUMENTS

| | | | |
|---|---|---|---|
| 453,797 | 6/1891 | Wickliffe | 273/23 |
| 890,789 | 6/1908 | Nelson | 273/23 |
| 3,836,145 | 9/1974 | Frejd | 273/23 |

FOREIGN PATENT DOCUMENTS

| | | | |
|---|---|---|---|
| 7466 | of 1884 | United Kingdom | 273/23 |
| 115606 | 5/1918 | United Kingdom | 273/23 |
| 309768 | 4/1929 | United Kingdom | 273/23 |

*Primary Examiner*—Richard C. Pinkham
*Assistant Examiner*—T. Brown
*Attorney, Agent, or Firm*—Richard P. Ulrich

[57] ABSTRACT

A cue bridge, comprising a cue support member, a rod attached to the cue support member, and means for slidably attaching the rod to a cue when the device is in use whereby the cue can be operated with one hand by handicapped persons.

3 Claims, 3 Drawing Figures

CUE BRIDGE

BACKGROUND AND SUMMARY OF INVENTION

This invention relates to an improvement in a cue bridge for use by handicapped persons when playing pool or billiards. Many persons who must use a wheelchair or who only have the use of one arm or hand would enjoy a game of pool if they had a bridge device attached to their cue in such a way that it could be manipulated with one hand. Therefore, it is an object of this invention to provide a device which can be attached to a cue and used as a bridge to enable a handicapped person to manipulate a cue with one hand.

Since many persons do not own their own cue, it is a further object of this invention to provide a bridge device which can be attached to a cue without damaging it.

The angle at which a cue strikes the cue ball controls the kind of motion imparted to the cue ball. Therefore, it is an additional object of this invention to provide a plurality of positions for resting the cue on the bridge to enable the user to strike the cue ball where needed to impart the kind of motion desired.

When a player is setting up to make a shot, it is useful to be able to position the bridge and then choose the angle at which the cue ball is to be attacked. Thus another object of this invention is to enable a user to change the angle of attack without changing the position of the bridge.

Another object of this invention, is to provide a device which remains attached to the cue while the cue is being used.

Often a cue ball will rest against a cushion and must be struck from that position. It is an additional object of this invention, to provide the means for placing the bridge adjacent to the cushion and in position to properly strike a cue ball resting against a cushion.

DESCRIPTION OF THE PREFERRED EMBODIMENTS

Figure 1:
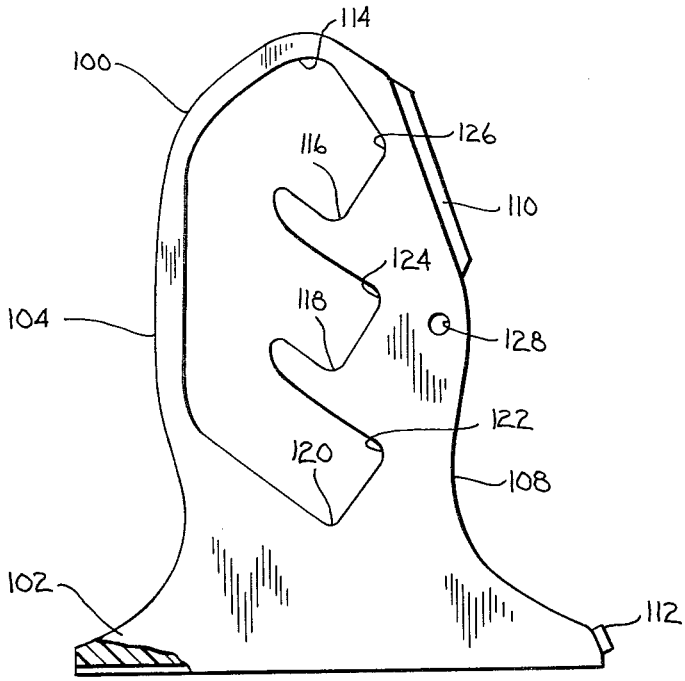
FIG. 1 is a view of the cue support member.

With reference to FIG. 1, member 100, which may be made of plastic or any other suitable material, has a base portion 102. Base 102 may be rounded and roughened and have lengthwise grooves. The length of base 102 is not critical so long as it is wide enough to provide a stable base for the cue when in use. In the preferred embodiment, base 102 was 3.5 inches long.

Left side 104 of member 100 has a curved portion beginning at the left side of base 102 and extending upwardly. The amount of curvature is not critical. It is desireable, however, that enough of the member be removed to allow the cue to be positioned one inch or less from a rail when member 100 is placed against a rail.

A similar curved portion 108 is provided on the right side of member 100.

Pad 110 and pad 112 are affixed to the right side of member 100 to provide surface of high friction which can be placed on the finished rails of a pool table when it is convenient to make a shot from this surface.

Internal cut-out or aperture 114 is made so that cue stations or steps 116, 118 and 120 are provided for the user when used in the position shown in FIG. 1 and stations or steps 122, 124 and 126 when the member 100 is rotated 90° for use on the finished rail of the pool table. The dimensions of each station or step are dictated by the size of a cue. In the model an opening of $\frac{5}{8}$ inches was maintained between surfaces to enable the passage a a cue therebetween.

Figure 2:
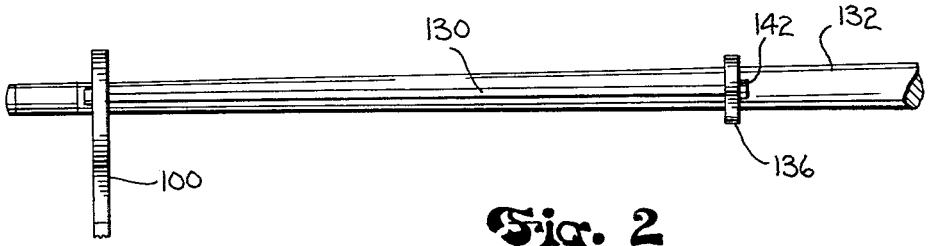
FIG. 2 shows the device attached to a cue.
Figure 3:
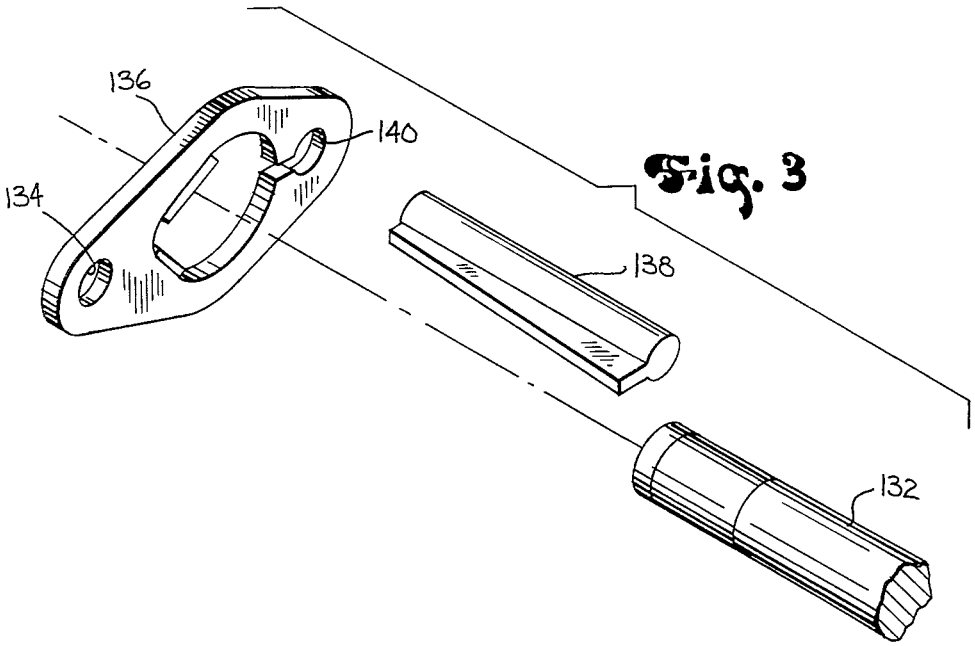
FIG. 3 shows the means for attaching the device to a cue.

Hole 128 provides the means for attaching rod 130 to member 100 as shown in FIG. 2. Rod 130, which may be made of fiberglass or any other suitable material, is the connecting link between member 100 and cue 132. The other end of rod 130 is slidably attached to cue 132 through hole 134 (FIG. 3) in member 136.

Member 136 is attached to cue 132 by inserting wedge 138 in slot 140. The position of member 136 on cue 132 is not critical so long as it is a sufficient distance from the tip of the cue to prevent the cue from slipping out of the bridge. In the model, rod 130 was made two feet long and member 136 was placed on cue 132 about 2 feet 1 inch from the tip of the cue. The end of rod 130 is prevented from sliding out of hole 134 by washer 142. (FIG. 2)

To use the device, rod 130 is inserted in hold 134. The threaded end of rod 130 is then attached to member 100 by threading the rod into tapped hold 128. Member 136 is then attached to cue 132.

What is claimed is:

1. A bridge comprising:

(a) a first support member having a base portion and concave sides, the curvature of said sides being such as to allow the base to extend under a cushion on a pool table when the bridge is in use, the first member having an aperture therein, the aperture having a plurality of steps formed therein, the steps being rests for a cue when a cue is extended through said aperture the cue being movable from step to step without removing it from the aperture;

(b) a rod, one end of which is attached to the first support member; a second member said second support member having a hole extending therethrough and being slidably attached to the other end of said rod, said second support member being attachable to a cue by extending said cue through said hole in said second member; and (d) means for attaching said second support member to a cue after extending the cue through the aperture in the first support member and the hole in the second support member, the cue remaining extended therethrough while the bridge is in use.

2. The bridge as claimed in claim 1 which further comprises pads affixed to at least one side of said first support member, said pads providing a surface of relatively high friction for use when the bridge is placed on a rail of a pool table.

3. The bridge as claimed in claim 2 wherein the second member is attached to the cue with a wedge.

* * * * *